United States Patent [19]

Theiss et al.

[11] Patent Number: 4,691,097

[45] Date of Patent: Sep. 1, 1987

[54] FAIL SAFE SAFETY CONTROL DEVICE

[75] Inventors: John J. Theiss, St. Louis, Mo.; Paul T. Durst, Louisville, Ky.

[73] Assignee: Temp. Systems, Inc., St. Louis, Mo.

[21] Appl. No.: 877,260

[22] Filed: Jun. 23, 1986

[51] Int. Cl.[4] ..... H05B 1/02

[52] U.S. Cl. ..... 219/513; 236/99 B; 337/309

[58] Field of Search ..... 337/309, 310, 311; 219/513, 510, 512; 236/99 B, 99 R, DIG. 2

[56] References Cited

U.S. PATENT DOCUMENTS 4,565,920 1/1986 Theiss et al. ..... 219/513

4,596,361 6/1986 Theiss et al. ..... 219/513

*Primary Examiner*—Harold Broome

*Attorney, Agent, or Firm*—Edward R. Weber

[57] ABSTRACT

A fail safe device for use in conjunction with a temperature sensing bulb, capillary, and control device in an oven or other heating appliance, which fail safe device will prevent a failure of the basic control device from permitting a critical overheat condition to occur in the controlled area.

17 Claims, 5 Drawing Figures

FAIL SAFE SAFETY CONTROL DEVICE

FIELD OF THE INVENTION

This invention relates generally to apparatus wherein a change in temperature is transmitted from a sensing bulb through a capillary to a control device, which control device regulates the application of heat to the area surrounding the sensing bulb. More particularly this invention is related to a novel, fail safe device for use in conjunction with a temperature sensing bulb, capillary, and control device in an oven or other heating appliance.

BACKGROUND OF THE INVENTION

Conventional thermostatic control devices used in home ovens and other heating devices typically have a controller consisting of a bulb located within the heated, area, a bellows or other operator located outside the heated area, and a capillary connecting the bulb and the operator. The entire system, bulb, capillary, and operator, is filled with a thermally responsive material so that as the bulb is exposed to heat, the material expands and thus moves the bellows or operator. Temperature control within the oven is obtained by linking the operator to a switch or valve so that the source of heat to the oven is turned off when the operator has moved a predetermined amount. The system works very well as long as the bulb, capillary, and bellows or other operator remains pressure-tight, so that an increase in the volume of the thermally responsive material results in movement of the operator. However, frequently a leak will develop in the system with the result that the thermally responsive material is permitted to leak out. When this occurs, an increase in heat in the area of the bulb does not cause a change in the position of the operator. In other instances, such as stuck or welded contacts, the source of heat may not be disconnected even though the operator has moved an amount normally sufficient to disconnect it. In either event, there is no control to interrupt the source of heat and a severe overheat situation may result. In extreme cases, this may cause a fire, or at a minimum, may cause the burning of whatever material is contained within the oven or other heating appliance. Thus, it is an object of this invention to prevent such an overheat situation when such a failure of the primary temperature control device occurs. It is a further object of the invention to provide a device which will positively interrupt the source of heat and thus "fail safe" in the event of a failure of the temperature control device.

SUMMARY OF THE INVENTION

The instant invention is a device which will disconnect the source of heat when a loss of pressure within the bulb-capillary-operator system occurs or when the system overheats for some other reason. Thus the system, when it fails, will be rendered safe and will not create a fire hazard.

BRIEF DESCRIPTION OF THE DRAWINGS

In the instant application.

DETAILED DESCRIPTION OF THE INVENTION

Figure 1:
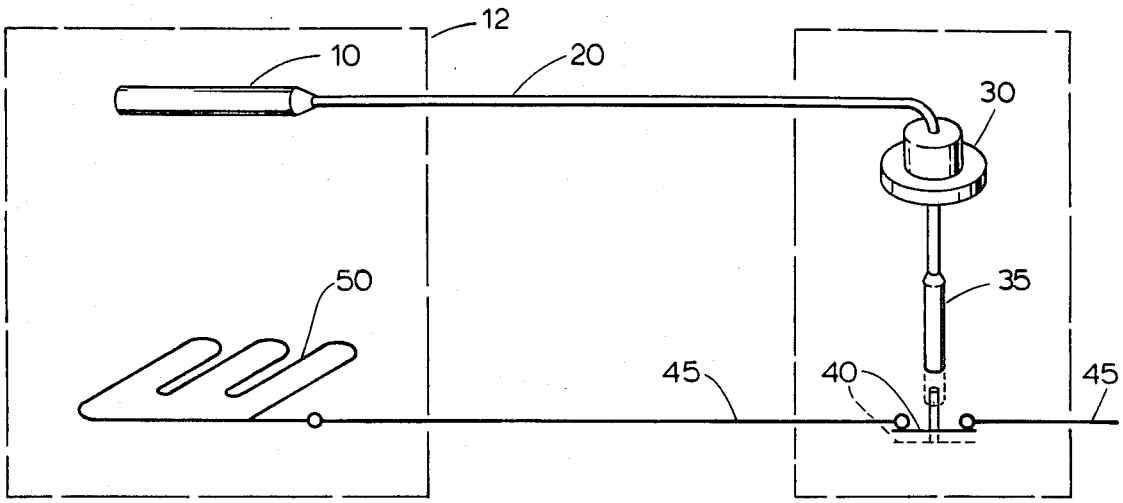
Fig. 1 PRIOR ART
FIG. 1 represents a schematic of a typical control system used to control the temperature of an electrically heated oven.

In FIG. 1, temperature sensing bulb 10 is located within oven 12 or other area for which the temperature is to be controlled. Capillary 20 connects bulb 10 with operator 30, which operator in turn operates switch 40 through linkage 35. Switch 40 controls the electrical current flowing through line 45 to heating element 50. During normal operation, operator 30 and linkage 35 are calibrated so that switch 40, normally closed, will be opened when the temperature surrounding bulb 10 reaches a predetermined level. This is accomplished by constructing bulb 10 and capillary 20 so that they are essentially nonelastic. In contrast to this, operator 30 is fabricated so that it is substantially elastic and can change in size when the volume of the thermally responsive material inside it changes. The entire assembly of bulb 10, capillary 20, and operator 30 is filled with thermally responsive material whose volume increases with increases in temperature. Thus, an increase in temperature surrounding bulb 10 will cause the material contained in bulb 10 to increase in volume. Since bulb 10 is essentially nonelastic, the increase in volume is transmitted through nonelastic capillary 20 to elastic operator 30, which increase in volume causes a change in the size of operator 30. When a predetermined change in size has occurred, linkage 35 opens switch 40 cutting off the electrical current to heating element 50. It is thus seen that a periodic cycling of switch 40 will serve to control the current through heating element 50 and in turn, control the temperature of the space containing heating element 50 and bulb 10. As has been previously pointed out, however, a leak in either bulb 10, capillary 20, or operator 30 results in a failure of the system, so that an increase in the temperature surrounding bulb 10 does not result in the opening of switch 40. The heating elements thus are permitted to be constantly on and the control function is totally eliminated with occasionally disastrous results. Similarly, if the contacts of switch 40 stick in a closed position so that operator 30 is unable to open the switch, a disastrous overheat condition may also result.

Figure 2:
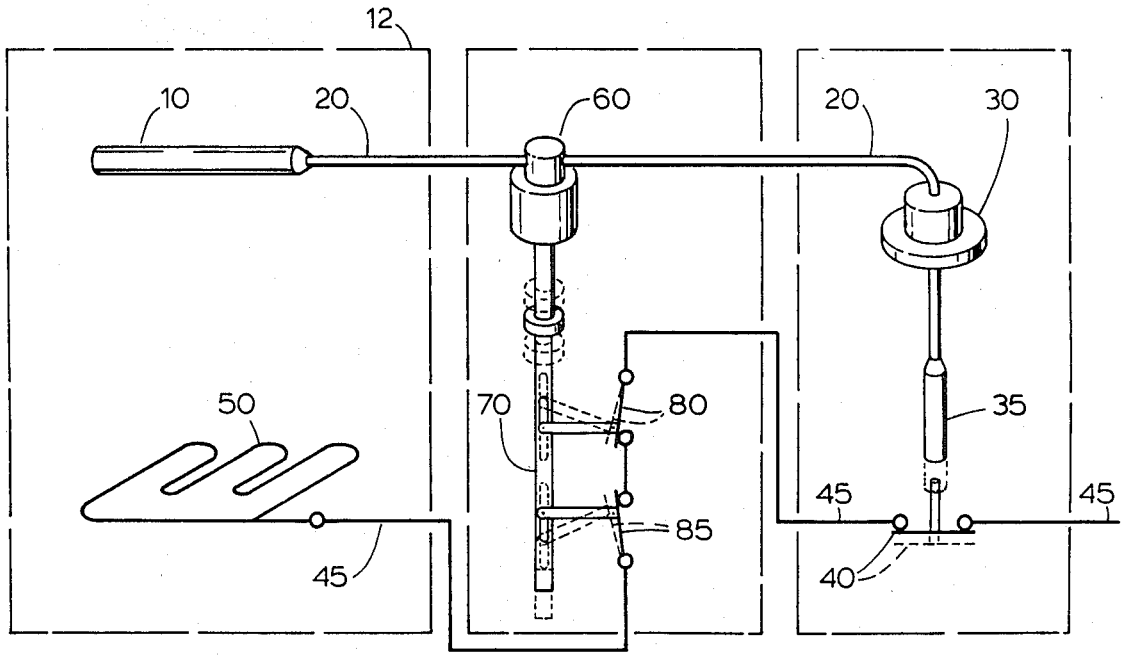
FIG. 2 represents the system as disclosed in FIG. 1 wherein the fail safe safety control of the instant invention has been incorporated into the system.

In FIG. 2, the fail safe safety control of the instant invention consisting of operator 60, linkage 70, and switches 80 and 85 has been inserted in the system. Operator 60 is linked to switches 80 and 85 in such a fashion that a decrease in the volume of the thermally responsive material in bulb 10 and capillary 20 beyond a certain pre-calibrated volume causes operator 60 to reposition linkage 70 permitting switch 80 to open and thus disconnect electrical current from heating element 50. Conversely, an increase in the volume of the thermally responsive material in bulb 10 and capillary 20 will cause operator 60 to reposition linkage 70 in such a fashion that switch 85 will open and also cause the electrical current to be disconnected from heating element 50. In this way the system is fail safe, as any leakage in the control system will cause switch 80 to open and any excessive thermally induced increase in volume will cause switch 85 to open. Thus, in either event, instead of having an overheat temperature condition, the heating element will be rendered inactive and the system will be rendered safe.

Operator 60, linkage 70, and switches 80 and 85 are adjusted so that switch 80 will remain closed so long as the bulb-capillary-operator system retains its pressure integrity. Only when a decrease in pressure below the basic calibrated pressure in the system occurs will operator 60 reposition linkage 70 so as to permit switch 80 to open and prevent the flow of electrical current to heating element 50. When installed, the system is calibrated so that the basic pressure in the system is sufficient to cause operator 60 and linkage 70 to maintain switch 80 in a closed condition at ambient temperatures. In this at rest condition, the volume of the system is such that switch 80 is closed, as is switch 40. As the temperature in oven 12 increases, bulb 10 is heated and the thermally responsive material contained therein expands and is transmitted through capillary 20 to operators 30 and 60. When a certain degree of expansion has occurred, switch 40 opens. Operator 60 and linkage 70 remain in the at rest state and switch 80 will remain closed regardless of the expansion of the thermally responsive material. It is only when a leak in the system causes the pressure in the system to drop below the basic pressure that operator 60 repositions linkage 70 which in turn opens switch 80.

Operator 60, linkage 70, and switch 85 are further adjusted so that switch 85 will remain closed so long as the bulb-capillary-operator system does not exceed a preselected volume. When an increase in temperature in oven 12 exceeds a preselected upper limit value, the increase in the volume of the thermally responsive material contained in bulb 10 and capillary 20 will cause operator 60 to reposition linkage 70 so as to permit switch 85 to open and prevent the flow of electrical current to heating element 50. Thus the combination of operator 60, linkage 70, and switches 80 and 85 creates a safety device which will cause the system to be rendered safe if a hazardous condition is caused by either a loss of thermally responsive material from the system or by welded contacts or other failure which creates an overheat temperature condition.

Figure 3:
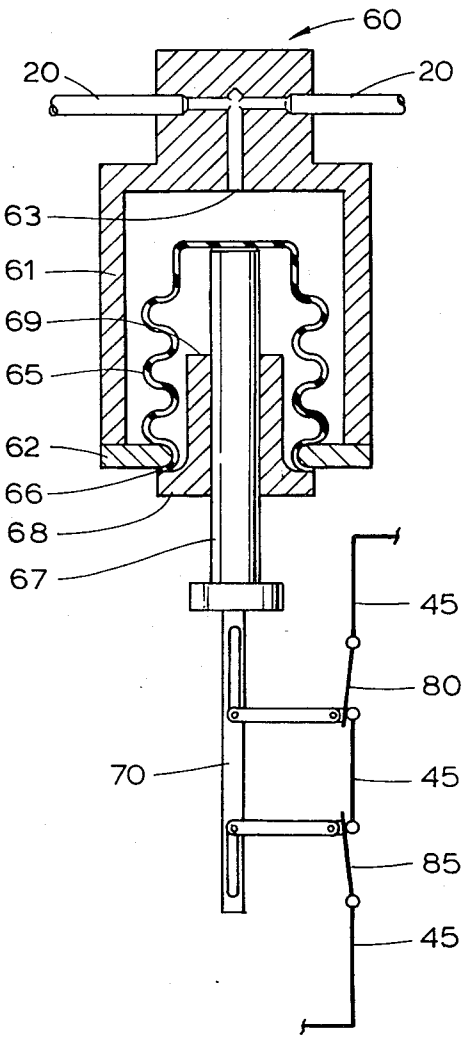
FIG. 3 is a partial cross-sectional view of one version of the fail safe safety control showing the control in its normal, at rest, configuration.

FIG. 3 presents a partial cross-sectional view of one embodiment of the fail safe safety control of the instant invention. In this embodiment, operator 60 consists of a rigid chamber 61 having an annular closure 62, a resilient bellows device 65 passing through the annulus in closure 62, and a flanged tube 68 which seals the open end 66 of bellows 65 and closure 62, thereby effectively creating a pressure containing chamber consisting of chamber 61, closure 62, bellows 65, and tube 68. A port 63 connects capillary 20 to the interior of said pressure containing chamber. Member 67 passes through the center of tube 68 and transmits the longitudinal movement of bellows 65 to the exterior of operator 60. Resilient bellows 65 is so designed that an increase in pressure in chamber 61 compresses the bellows, forcing member 67 out of tube 68 and creating an effective elongation of operator 60. Conversely, a decrease in pressure will permit bellows 65 to return to its basic length causing member 67 to retract into tube 68, and thus effectively shorten operator 60. As has been previously mentioned in the description of FIG. 2, this change is communicated to switches 80 and 85 through linkage 70.

When installed, the system is calibrated so that the pressure in the system is sufficient to maintain bellows 65 in a partially compressed state at ambient temperatures. In this at rest condition, switches 80 and 85 are closed, as is switch 40. As the temperature in the oven increases, bulb 10 is heated and the thermally responsive material expands and is transmitted through capillary 20 to operators 30 and 60. When a certain degree of expansion has occurred, switch 40 opens; bellows 65 remains partially compressed and operator 60 remains in a partially elongated state throughout this nominal increase in pressure.

Figure 4:
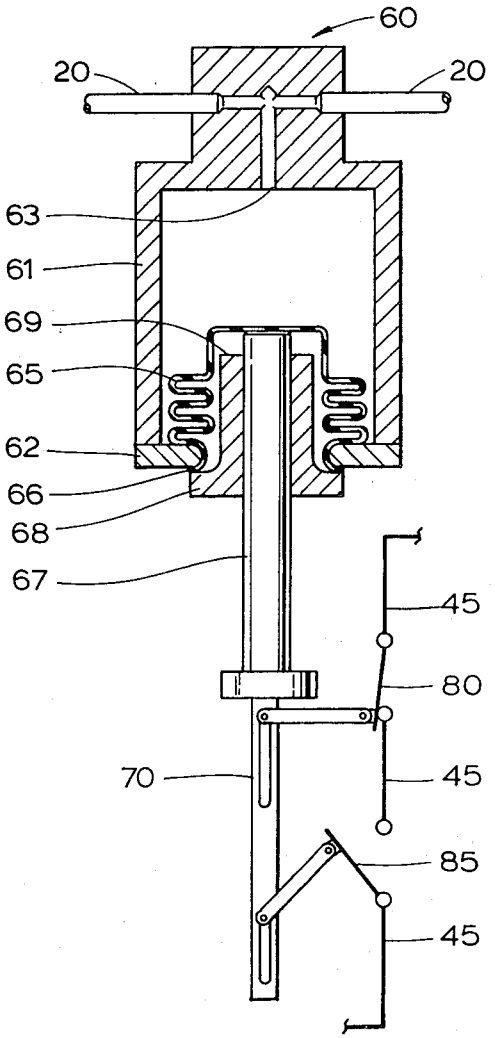
FIG. 4 is a partial cross-sectional view of the device of FIG. 3 showing the control in the configuration resulting from an overheat condition.

FIG. 4 illustrates the change in the system if switch 40 does not open at the set temperature. As the temperature continues to increase, the volume of the thermally responsive material will continue to increase. This increase in volume will cause bellows 65 to be compressed to a greater extent with the result that member 67 is caused to extend from tube 68 to a greater degree. When the temperature in oven 12 has reached a preselected upper safety limit, member 67, operating through linkage 70, will cause switch 85 to open and thus interrupt the heat. Thus the device of the instant application will prevent an overheat condition from occurring in oven 12.

Figure 5:
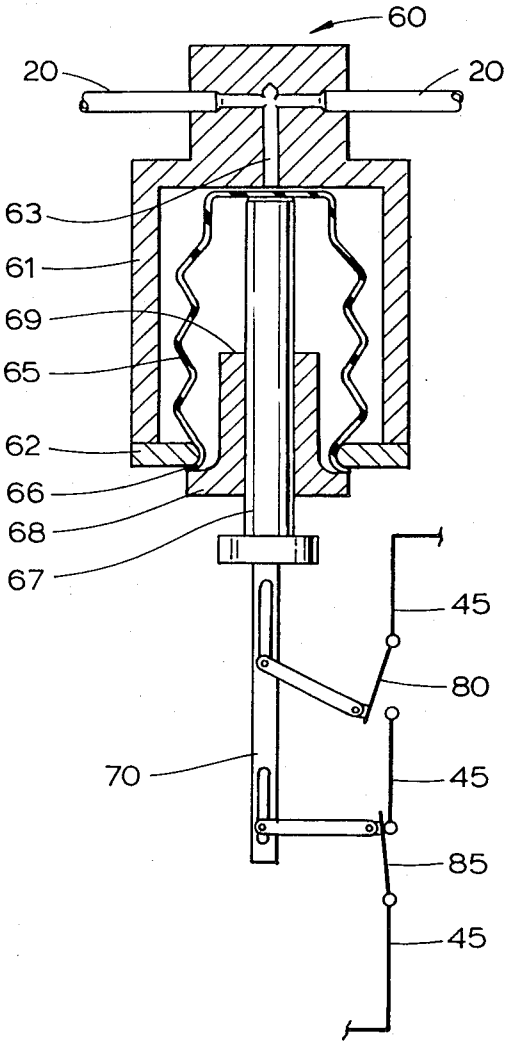
FIG. 5 is a partial cross-sectional view of the device of FIG. 3 showing the control in the configuration resulting from a leakage of thermally responsive material.

FIG. 5 illustrates the change when a leak in the system occurs. The pressure in chamber 61 decreases to the point where bellows 65 returns to its basic length, thus causing member 67 to withdraw into tube 68, which in turn operates linkage 70 which opens switch 80. This also interrupts the heat and prevents an overheat condition in oven 12.

In view of the above, it will be seen that the objects of the invention are achieved and other advantageous results are obtained. As various changes can be made in the above constructions without departing from the scope of the invention, it is intended that all matter contained in the above description or shown in the accompanying drawings shall be interpreted as illustrative and not in a limiting sense.

What is claimed is:

1. In a temperature control system consisting of a nonelastic container adapted to be subject to temperature changes, a capillary tube connected to said container and extending to a first pressure responsive device, a thermally expansible and contractable material filling said container, said tube, and said first pressure responsive device, and a linkage connecting said first pressure responsive device to a first control device whereby changes in the first pressure responsive device, resulting from expansion or contraction of the expansible/contractable material caused by changes in the temperature of the area surrounding said nonelastic container, open or close the first control device so as to regulate when a primary heating device is supplying heat, the improvement wherein a second pressure responsive mechanism is interconnected with the material-filled capillary tubing in such a fashion that changes in the second pressure responsive device, resulting from expansion or contraction of the expansible/contractable material caused by the temperature of the area surrounding said nonelastic container having reached a preselected upper safety limit value, will activate a second control device so as to prevent the primary heating device from supplying heat; which second pressure responsive device will also activate a third control device to prevent the primary heating device from supplying heat when the expansible/contractable material does not completely fill the bulb, capillary tube, first pressure responsive device, and second pressure responsive device.

2. The mechanism of claim 1 wherein the primary heating device is an electrical heating element and the control devices are switches controlling the flow of electrical current to the electrical heating element.

3. The mechanism of claim 1 wherein the primary heating device is a burner and the control devices are valves controlling the flow of combustible material to the burner.

4. The mechanism of claim 1 wherein the linkages connecting the first and second pressure responsive mechanisms and the respective control devices are non-electric mechanisms utilizing pneumatic or hydraulic operators.

5. The mechanism of claim 1 wherein the second pressure responsive device includes a bellows which is maintained in a partially compressed state by the pressure derived from the thermally expansive material when the system is at ambient temperature, and wherein the second control device is an electrical switch with contacts which are normally open, which contacts are maintained closed as long as the bellows remain partially compressed, and the third control device is an electrical switch with contacts which are normally closed, which contacts are opened when the bellows of the second pressure responsive device are compressed a preselected amount beyond the partially compressed state present under normal operating conditions.

6. In a temperature control system consisting of a nonelastic container adapted to be subject to temperature changes, a capillary tube connected to said container and extending to a first pressure responsive device, a thermally expansible and contractable material filling said container, said tube, and said first pressure responsive device, and a linkage connecting said first pressure responsive device to a first control device whereby changes in the first pressure responsive device, resulting from expansion or contraction of the expansible/contractable material caused by changes in the temperature of the area surrounding said nonelastic container, open or close the first control device so as to regulate when a primary heating device is supplying heat, the improvement wherein a second pressure responsive mechanism is interconnected with the material-filled capillary tubing in such a fashion that changes in the second pressure responsive device, resulting from expansion or contraction of the expansible/contractable material caused by the temperature of the area surrounding said nonelastic container having reached a preselected upper safety limit value, will activate a second control device so as to prevent the primary heating device from supplying heat; which second pressure responsive device will also activate said second control device to prevent the primary heating device from supplying heat when the expansible/contractable material does not completely fill the bulb, capillary tube, first pressure responsive device, and second pressure responsive device.

7. The mechanism of claim 5 wherein the second pressure responsive device includes a bellows which is maintained in a partially compressed state by the pressure derived from the thermally expansible material when the system is at ambient temperature, and the second control device is an electrical switch with contacts which are normally open, which contacts are closed when said bellows is partially compressed, but which contacts are permitted to open either when said bellows is compressed a preselected amount beyond the partially compressed state present under normal operating conditions or when said bellows return to the basic uncompressed condition.

8. A fail-safe temperature control system which in addition to providing conventional temperature control also functions as a high temperature safety limit control and a loss of operating media safety control which system consists of a single nonelastic container adapted to be subject to temperature changes, a first pressure responsive device, a second pressure responsive device, a capillary tube connecting said container, said first pressure responsive device and said second pressure responsive device and a thermally expansible and contractable operating media filling said container, said tube, and said first and second pressure responsive devices, a linkage connecting said first pressure responsive device to a first control device whereby changes in the first pressure responsive device, resulting from expansion or contraction of the expansible/contractable operating media caused by changes in the temperature of the area surrounding said nonelastic container, open or close the first control device so as to regulate when a primary heating device is supplying heat, a second linkage connecting said second pressure responsive device to a second control device whereby changes in the second pressure responsive device, resulting from expansion or contraction of the expansible/contractable operating media caused by the temperature of the area surrounding said nonelastic container having reached a preselected upper safety limit value, will activate said second control device so as to prevent the primary heating device from supplying heat; and a third control device also connected to said second linkage, which third control device will prevent the primary heating device supplying heat when the expansible/contractable operating media does not completely fill the bulb, capillary tube, first pressure responsive device, and second pressure responsive device.

9. The system of claim 8 wherein the primary heating device is an electrical heating element and the control devices are switches controlling the flow of electrical current to the electrical heating element.

10. The system of claim 8 wherein the primary heating device is a burner and the control devices are valves controlling the flow of combustible material to the burner.

11. The system of claim 8 wherein the linkages connecting the first and second pressure responsive mechanisms and the respective control devices are non-electric mechanisms utilizing pneumatic or hydraulic operators.

12. The system of claim 8 wherein the second pressure responsive device includes a bellows which is maintained in a partially compressed state by the pressure derived from the thermally expansive material when the system is at ambient temperature, and wherein the second control device is an electrical switch with contacts which are normally open, which contacts are closed as long as the bellows remain partially compressed, and the third control device is an electrical switch with contacts which are normally closed, which contacts are opened when the bellows of the second pressure responsive device is compressed a preselected amount beyond the partially compressed state present under normal operating conditions.

13. A fail-safe temperature control system which in addition to providing conventional temperature control also functions as a high temperature safety limit control and a loss of operating media safety control which system consists of a single nonelastic container adapted to be subject to temperature changes, a first pressure responsive device, a second pressure responsive device, a capillary tube connecting said container, said first pressure responsive device and said second pressure responsive device and a thermally expansible and contractable operating media filling said container, said tube, and said first and second pressure responsive devices, a linkage connecting said first pressure responsive device to a first control device whereby changes in the first pressure responsive device, resulting from expansion or contraction of the expansible/contractable operating media caused by changes in the temperature of the area surrounding said nonelastic container, open or close the first control device so as to regulate when a primary heating device is supplying heat, a second linkage connecting said second pressure responsive device to a second control device whereby changes in the second pressure responsive device, resulting from expansion or contraction of the expansible/contractable operating media caused by the temperature of the area surrounding said nonelastic container having reached a preselected upper safety limit value, will activate said second control device so as to prevent the primary heating device from supplying heat; which second pressure responsive device operating thru said second linkage will also activate said second control device to prevent the primary heating device from supplying heat when the expansible/contractable operating media does not completely fill the bulb, capillary tube, first pressure responsive device, and second pressure responsive device.

14. The system of claim 13 wherein the primary heating device is an electrical heating element and the control devices are switches controlling the flow of electrical current to the electrical heating element.

15. The system of claim 13 wherein the primary heating device is a burner and the control devices are valves controlling the flow of combustible material to the burner.

16. The system of claim 13 wherein the linkages connecting the first and second pressure responsive mechanisms and the respective control devices are non-electric mechanisms utilizing pneumatic or hydraulic operators.

17. The system of claim 13 wherein the second pressure responsive device includes a bellows which is maintained in a partially compressed state by the pressure derived from the thermally expansive material when the system is at ambient temperature, and wherein the second control device is an electrical switch with contacts which are normally open, which contacts are closed as long as the bellows remain partially compressed, but which open when the bellows returns to its uncompressed condition which contacts also open when the bellows of the second pressure responsive device is compressed a preselected amount beyond the partially compressed state present under normal operating conditions.

* * * * *